US009184479B2

(12) United States Patent
Chun et al.

(10) Patent No.: US 9,184,479 B2
(45) Date of Patent: Nov. 10, 2015

(54) MULTI MODE FILTER FOR REALIZING WIDE BAND USING CAPACITIVE COUPLING / INDUCTIVE COUPLING AND CAPABLE OF TUNING COUPLING VALUE

(75) Inventors: Dong-Wan Chun, Incheon (KR); Jae-Wong Jang, Incheon (KR); Ki-Soo Shin, Incheon (KR)

(73) Assignee: Ace Technologies Corporation, Incheon-si (KR)

( * ) Notice: Subject to any disclaimer, the term of this patent is extended or adjusted under 35 U.S.C. 154(b) by 451 days.

(21) Appl. No.: 13/474,435

(22) Filed: May 17, 2012

(65) Prior Publication Data

US 2012/0293281 A1 Nov. 22, 2012

(30) Foreign Application Priority Data

May 19, 2011 (KR) ..... 10-2011-0047372
May 19, 2011 (KR) ..... 10-2011-0047388

(51) Int. Cl.
*H01P 1/208* (2006.01)
*H01P 7/10* (2006.01)
*H01P 7/06* (2006.01)

(52) U.S. Cl.
CPC ..... *H01P 1/2086* (2013.01); *H01P 1/2084* (2013.01); *H01P 7/06* (2013.01); *H01P 7/105* (2013.01)

(58) Field of Classification Search
CPC ..... H01P 1/2056; H01P 7/10; H01P 7/06; H01P 1/2086; H01P 1/2084; H01P 7/105
USPC ..... 333/17.1, 202, 203, 219.1, 224, 227, 333/230, 231, 232, 233, 235
See application file for complete search history.

(56) References Cited

U.S. PATENT DOCUMENTS 4,453,146 A * 6/1984 Fiedziuszko ..... 333/212
5,831,496 A * 11/1998 Sonoda et al. ..... 333/202
6,975,181 B2 * 12/2005 Jang ..... 333/134
2002/0041221 A1 * 4/2002 Abdulnour ..... 333/202

FOREIGN PATENT DOCUMENTS

WO WO 2010028450 A1 * 3/2010

* cited by examiner

*Primary Examiner* — Benny Lee
*Assistant Examiner* — Jorge Salazar, Jr.
(74) *Attorney, Agent, or Firm* — TechLaw LLP

(57) ABSTRACT

A multi-mode filter for realizing wide band using capacitive coupling and inductive coupling and capable of tuning coupling value is disclosed. The multi-mode filter includes a housing; a first cavity and a second cavity formed in the housing; a first resonator located in the first cavity, a second resonator located in the second cavity, a wall configured to separate the first cavity from the second cavity; and a first coupling element, wherein a groove is formed between the housing and the wall, the first coupling element is inserted in the groove in crossing direction to the wall, one part of the first coupling element is disposed in the first cavity, another part of the first coupling element is disposed in the second cavity, and the first coupling element is connected to a ground.

15 Claims, 12 Drawing Sheets

- PRIOR ART -

(A)

(B)

MULTI MODE FILTER FOR REALIZING WIDE BAND USING CAPACITIVE COUPLING / INDUCTIVE COUPLING AND CAPABLE OF TUNING COUPLING VALUE

The present application claims priority to foreign patent applications KR 10-2011-0047388 and KR 10-2011-0047372 both filed on May 19, 2011.

TECHNICAL FIELD

Example embodiments of the present invention relate to a multi-band filter for generating sufficient coupling amount for multi-mode.

BACKGROUND ART

In conventional multi-mode filter, coupling elements is located in coupling windows on a wall to generate coupling between resonators.

The conventional multi-mode filter may obtain sufficient coupling amount in single mode, but can't realize sufficient coupling amount in multi-mode. Consequently, the conventional multi-mode filter has been used only as a narrow band filter.

In addition, if manufacturing of the conventional multi-mode filter is completed, coupling value of the conventional multi-mode filter can't tune any more.

DISCLOSURE

Technical Problem

Example embodiment of the present invention provides a multi-band filter for realizing wide band and obtaining various coupling values.

Example embodiment of the present invention also provides a multi-mode filter for realizing wide band and tuning coupling value.

Technical Solution

A multi-mode filter according to one embodiment of the present invention includes a housing; a first cavity and a second cavity formed in the housing; a first resonator located in the first cavity; a second resonator located in the second cavity; a wall configured to separate the first cavity from the second cavity; and a first coupling element, wherein a groove is formed between the housing and the wall, the first coupling element is located in the groove in the direction crossing over the wall, a part of the first coupling element is disposed in the first cavity, another part of the first coupling element is disposed in the second cavity, the first coupling element is electrically connected to a ground.

a first cavity and a second cavity formed in the housing; a first resonator located in the first cavity; a second resonator located in the second cavity; a wall configured to separate the first cavity from the second cavity; and a coupling element, wherein a groove is formed between the housing and the wall, the coupling element is located in the groove in the direction crossing over the wall, a part of the coupling element is disposed in the first cavity, another part of the coupling element is disposed in the second cavity, and the coupling element is electrically open.

A multi-mode filter according to still another embodiment of the present invention includes a housing; a first cavity and a second cavity formed in the housing; a first resonator located in the first cavity; a second resonator located in the second cavity; a wall configured to separate the first cavity from the second cavity; a first coupling element; and at least one tuning element, wherein a groove is formed between the housing and the wall, the first coupling element is inserted in the groove in the direction crossing over the wall, a part of the first coupling element is disposed in the first cavity, another part of the first coupling element is disposed in the second cavity, the at least one tuning element is disposed to face the first coupling element with located in at least one of the first cavity and the second cavity.

Advantageous Effects

In a multi-mode filter according to the present invention, a coupling element having "⊓" shape is located in a groove formed between a housing and a wall and is disposed in corresponding cavities, and thus both E-field coupling and H-field coupling are generated between corresponding resonator and the coupling element. Accordingly, coupling value between the resonators increases, so the multi-mode filter may realize wide band.

In addition, width or height of the coupling element may be modified variously, and thus the multi-mode filter may have various structures of coupling elements. Consequently, the multi-mode filter may achieve desired coupling value according to purpose in use.

Furthermore, the coupling value is adjusted by using the tuning element set to a position facing to the coupling element, and thus the multi-mode filter may tune coupling value to desired value.

BRIEF DESCRIPTION OF DRAWINGS

Example embodiments of the present invention will become more apparent by describing in detail example embodiments of the present invention with reference to the accompanying drawings, in which.

DETAILED DESCRIPTION

Hereinafter, embodiments of the present invention will be described in detail with reference to accompanying drawings.

Figure 1:
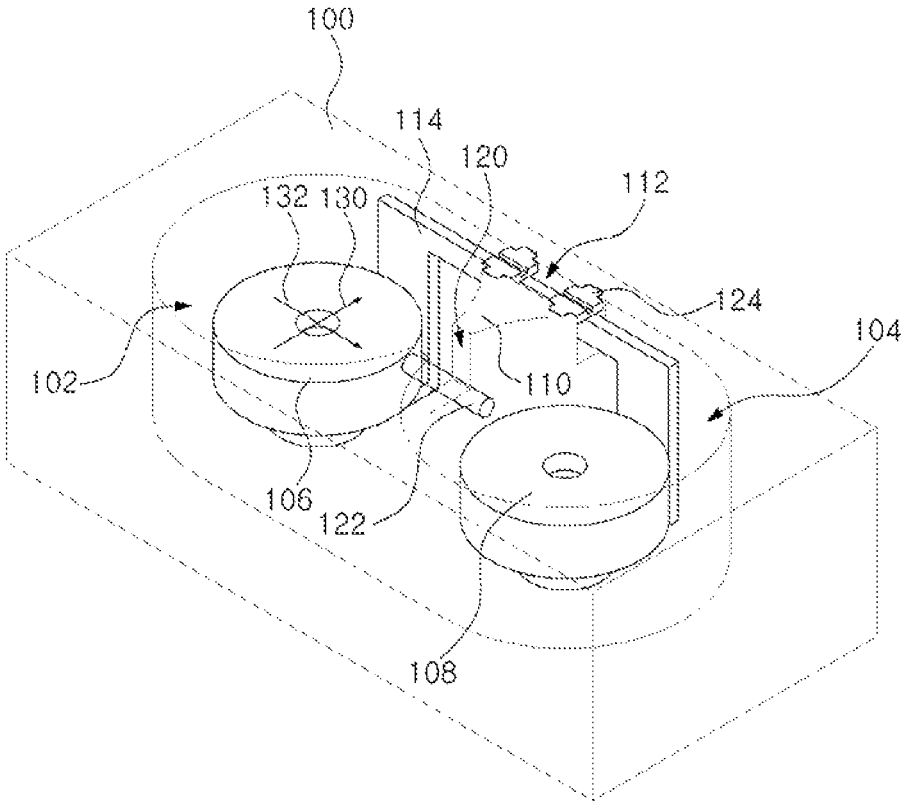
FIG. 1 is a perspective view illustrating a multi-mode filter according to a first embodiment of the present invention.
Figure 2:
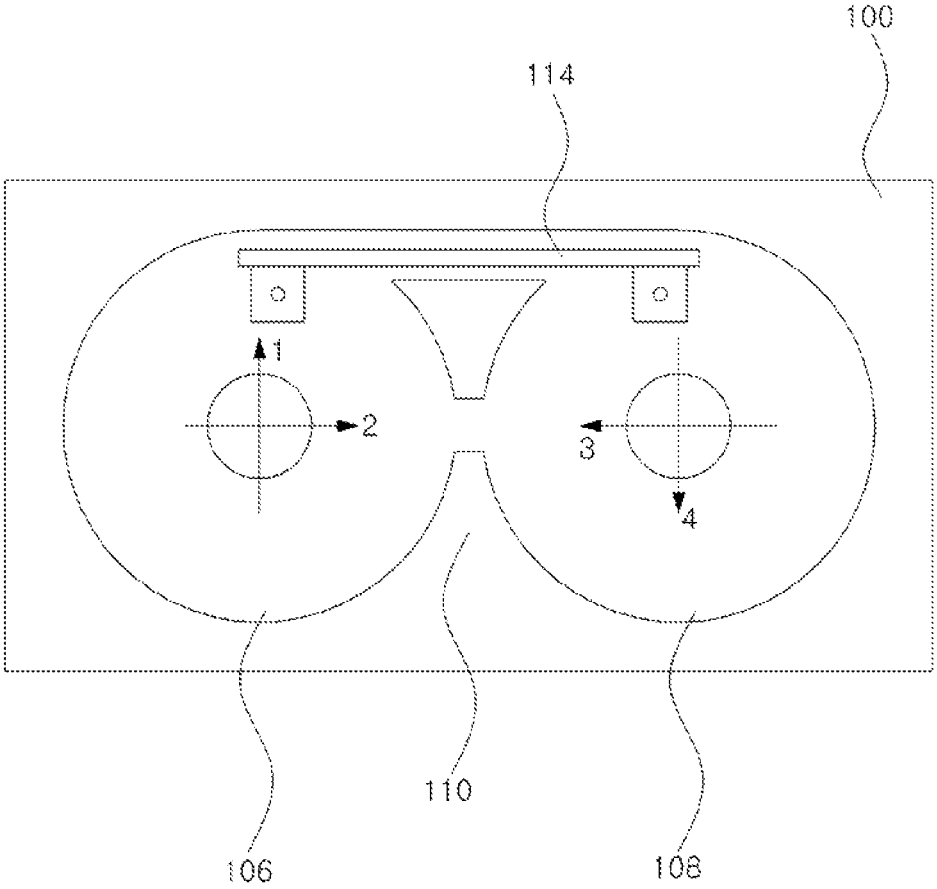
FIG. 2 is a plan view illustrating the multi-mode filter according to the first embodiment of the present invention.
Figure 3:
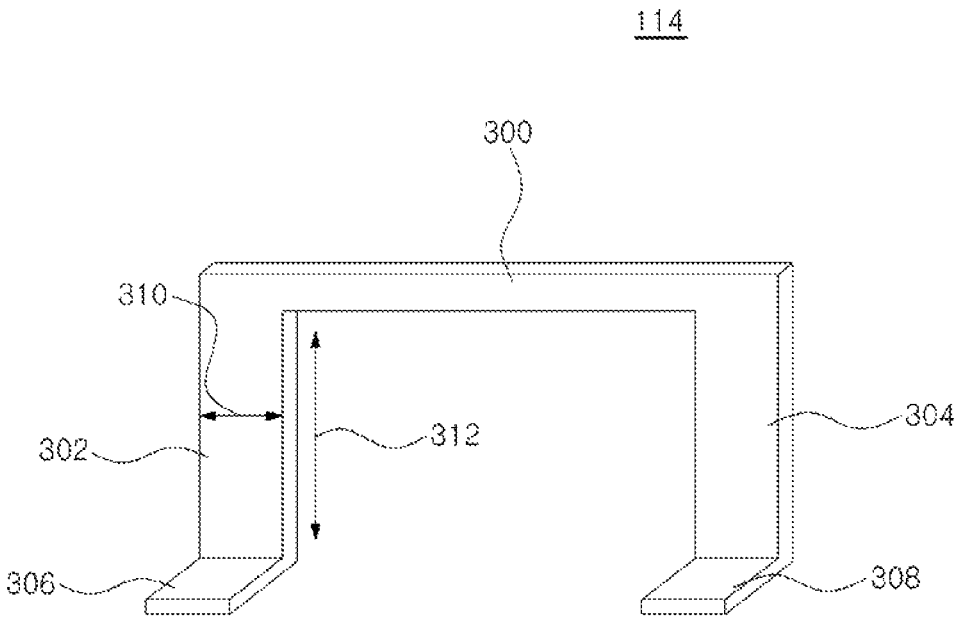
FIG. 3 is a perspective view illustrating a coupling element according to one embodiment of present invention.

FIG. 1 is a perspective view illustrating a multi-mode filter according to a first embodiment of the present invention, FIG. 2 is a plan view illustrating the multi-mode filter according to the first embodiment of the present invention, and FIG. 3 is a perspective view illustrating a coupling element according to one embodiment of present invention.

Referring to FIG. 1, the multi-mode filter of the present embodiment includes housing 100, a first cavity 102, a second cavity 104, a first resonator 106, a second resonator 108, a wall 110, a first coupling element 114, a second coupling element 122 and fixing member 124.

The housing 100 protects elements in the multi-mode filter, and blocks an electromagnetic wave. The housing 100 may be formed by coating silver having high conductivity on an aluminum material and operates as a ground The cavities 102 and 104 are space formed in the housing 100 for resonance, and defined by the wall 110. In FIG. 1, each of the cavities 102 and 104 has cylindrical shape, but may have various shapes as rectangular shape.

The first resonator 106 is located in the first cavity 102 and the second resonator 108 is located in the second cavity 104. The cavities 106 and 108 may be made up of a metal or dielectric member according to mode of the multi-mode filter, i.e. TE mode or TM mode.

In FIG. 1, each of the resonators 106 and 108 has cylindrical shape, but may have various shapes as rectangular shape or disk shape.

According to one embodiment of the present invention, a first mode 130 and a second mode 132 crossing to (for example, perpendicular to) the first mode 130 may be generated at the first resonator 106 as shown in FIGS. 1 and 2. Also, a third mode corresponding to the first mode 130 and a fourth mode corresponding to the second mode 132 may be generated at the second resonator 108. Meanwhile, the number of modes generated at the resonators 106 and 108 may be three and more.

According to one embodiment of the present invention, if height of the resonators 106 and 108 relatively low (namely the resonators 106 and 108 have flat cylindrical shape), the first mode 130 and the second mode 132 may be HEH mode. In another embodiment of the present invention, if height of the resonators 106 and 108 is relatively high, the first mode 130 and the second mode 132 may be HEE mode.

In the multi-mode filter, field is generated at each of an upper surface and a lower surface of the resonator 106 or 108. Therefore, to tune electrical coupling between resonators 106 and 108, the field at the upper surface and the lower surface of the resonator 106 or 108 should be controlled.

However, in case of the HEH mode, coupling value between the resonators 106 and 108 is almost determined by the field at the upper surface of the resonator 106 or 108, and the field at the lower surface of the resonator 106 or 108 do nearly affect to coupling between the resonators 106 and 108. Therefore, in case of the HEH mode, the multi-mode filter according to the present invention may tune electrical coupling value between resonators 106 and 108 by controlling the field at the upper surface of the resonator 106 or 108.

According to one embodiment of the present invention, a groove 112 may be formed between the housing 100 and the wall 110 to interconnect the cavities 102 and 104.

The first coupling element 114 is disposed in the cavities 102 and 104 under the condition that it is located in the groove.

According to one embodiment of the present invention, the first coupling element 114 is metal and may include a first coupling member 300, a second coupling member 302, a third coupling member 304, a fourth coupling member 306 and a fifth coupling member 308 as shown in FIG. 3.

The first coupling member 300 is inserted in the groove 112 in the direction crossing over the wall. In this case, a fixing member 124 may fix and maintain the first coupling member 300.

The second coupling member 302 is longitudinal-extended from the first coupling member 300 in the direction vertical to the first coupling member 300, and it is located in the first cavity 102. In this case, the second coupling member 302 may be separated from or in contact with an inner surface of the housing 100 corresponding to the first cavity 102.

The third coupling member 304 is longitudinal-extended from the first coupling member 300 in the direction vertical to the first coupling member 300, and it is located in the second cavity 104. In this case, the third coupling member 304 may be separated from or in contact with the inner surface of the housing 100 corresponding to the second cavity 104. In addition, the third coupling member 304 may be disposed symmetrically to the second coupling member 302.

The fourth coupling member 306 is longitudinal-extended from the second coupling member 302 in the direction vertical to the second coupling member 302 and it may be disposed on a bottom surface of the housing 100 corresponding to the first cavity 102. Consequently, the first coupling element 114 is electrically connected to a ground.

The fifth coupling member 308 is longitudinal-extended from the third coupling member 304 in the direction vertical to the third coupling member 304 and it may be disposed on a bottom surface of the housing 100 corresponding to the second cavity 104. Consequently, the first coupling element 114 is electrically connected to a ground.

According to one embodiment of the present invention the fourth coupling member 306 and the fifth coupling member 308 may be fixed on the bottom surface of the housing 100 through a metal screw. In this case, the first coupling element 114 is fixed stably on the bottom surface of the housing 100, and so the fixing member 124 may not be used.

In summary, the first coupling element 114 has "ㄇ" shape and is electrically connected to the housing 100 which is a ground.

E field coupling 310 (namely, capacitive coupling) and H field coupling 312 (namely, inductive coupling) is generated between the second coupling member 302 and the first resonator 106. E field coupling and H field coupling is also generated between the third coupling member 304 and the second resonator 108.

According to one embodiment of the present invention, E field coupling 310 may be controlled by properly setting the area of the second coupling member 302 or the third coupling member 304, and H field coupling 312 may be controlled by properly setting the height of the second coupling member 302 or the third coupling member 304. In other words, coupling value between resonators 106 and 108 may be controlled by properly setting the area or the height of the second coupling member 302 or the third coupling member 304.

The second coupling member 302 and the third coupling member 304 are disposed symmetrically and have the same size in FIGS. 1 and 3, but may be disposed asymmetrically and have different size. For example, the area of the second coupling member 302 may be different from that of the third coupling member 304. That is, the multi-mode filter according to the first embodiment of the present invention may achieve various coupling values between resonators 106 and 108 by setting properly area or height of the second coupling member 302 and the third coupling member 304.

Now referring to FIG. 1 again, a groove, 120 (namely, coupling window) may be formed at the wall 110, and the second coupling element 122 may be disposed in the coupling window 120. However, since it is possible to obtain sufficient coupling value between the resonators 106 and 108 using only the first coupling element 114, the coupling window 120 may not be formed on the wall or the second coupling element 122 may not be exist.

Comparison between conventional dual-mode filter and the multi-mode filter according to the first embodiment of the present invention is as follows.

The conventional dual-mode filter controls only E field coupling (capacitive coupling) through a coupling window, and thus it is impossible to achieve sufficient coupling for at the dual-mode filter.

Whereas, the multi-mode filter of the present embodiment controls coupling value between the resonators 106 and 108 using both of the E field coupling (capacitive coupling) and the H-field coupling (inductive coupling). Consequently, the multi-mode filter of the present embodiment may obtain sufficient coupling value. Specially, since structure of the first coupling element 114 may be modified variously, the multi-mode filter of the present embodiment may achieve various desired coupling values.

In addition, because the first coupling element 114 is fixed on the bottom surface of the housing 100 through the metal screw, the first coupling element 114 may be fixed stably even if an external impact (vibration, extreme changes in temperature, shock etc.) occurs.

Hereinafter, experimental result of coupling characteristics of the conventional dual-mode filter and the multi-mode filter according to the first embodiment of the present invention will be described in detail with reference to accompanying drawings.

Figure 4:
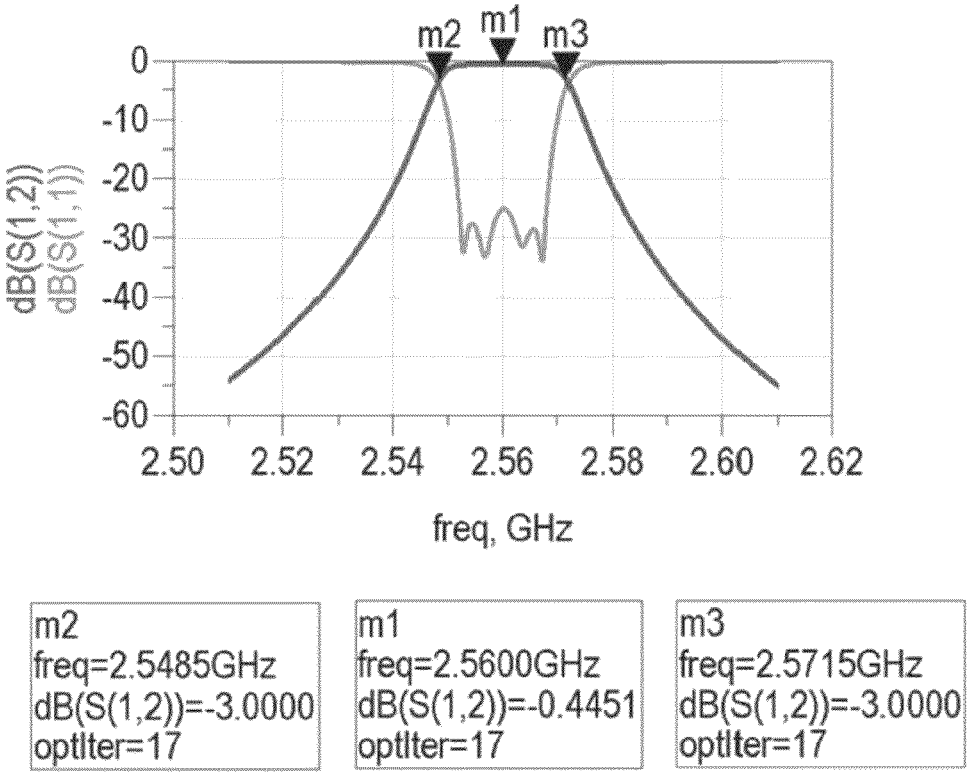
FIG. 4 is a view illustrating result graph of coupling simulation about conventional dual-mode filter.
Figure 5:
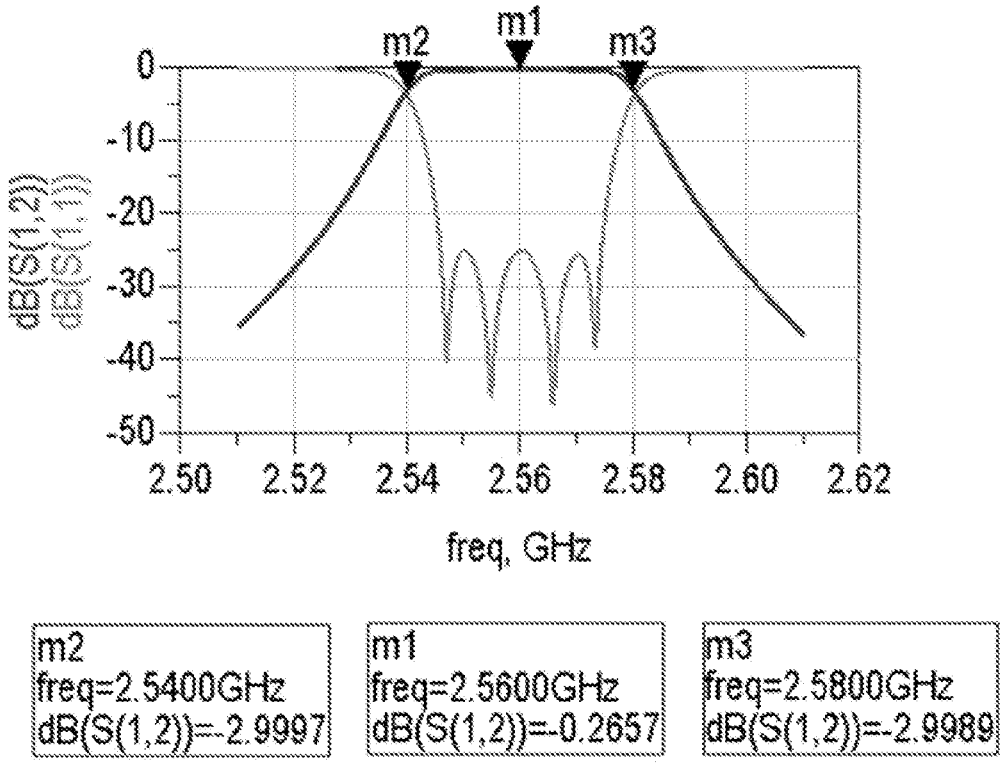
FIG. 5 is a view illustrating result graph of coupling simulation about the multi-mode filter according to the first embodiment of the present invention.

FIG. 4 is a view illustrating result graph of coupling simulation about conventional dual-mode filter, FIG. 5 is a view illustrating result graph of coupling simulation about the multi-mode filter according to the first embodiment of the present invention.

Referring to FIG. 4, the conventional dual-mode filter realizes bandwidth of 23 MHz at center frequency of 2.56 GHz, i.e. realizes narrow band of 0.89%. This is because sufficient coupling is not generated between resonators.

On the other hand, the multi-mode filter according to the first embodiment of the present invention may realize bandwidth of 40 MHz at center frequency of 2.56 GHz, i.e. realizes wide band of 1.64%. This is because sufficient coupling is generated between the resonators 106 and 108 by using both E-field coupling (capacitive coupling) and H-field coupling (inductive coupling).

Figure 6:
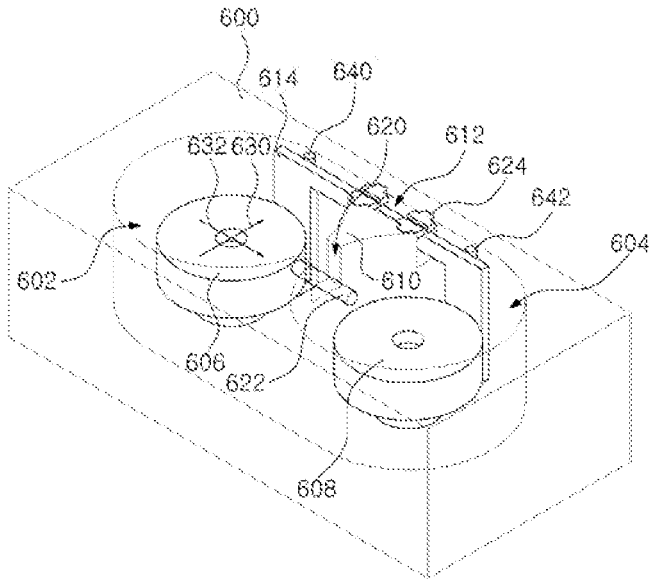
FIGS. 6A and 6B are perspective views illustrating a multi-mode filter according to a second embodiment of the present invention.
Figure 6:
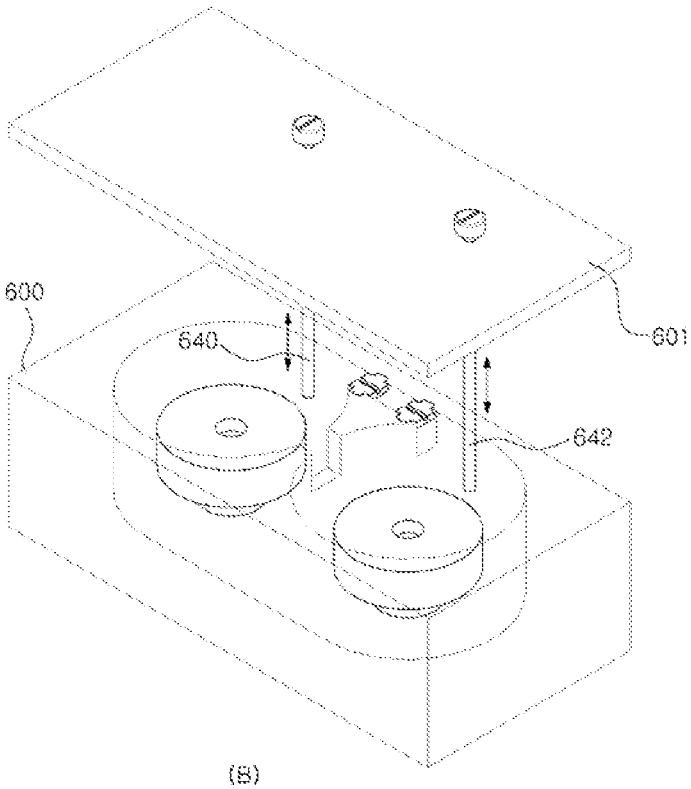
Figure 7:
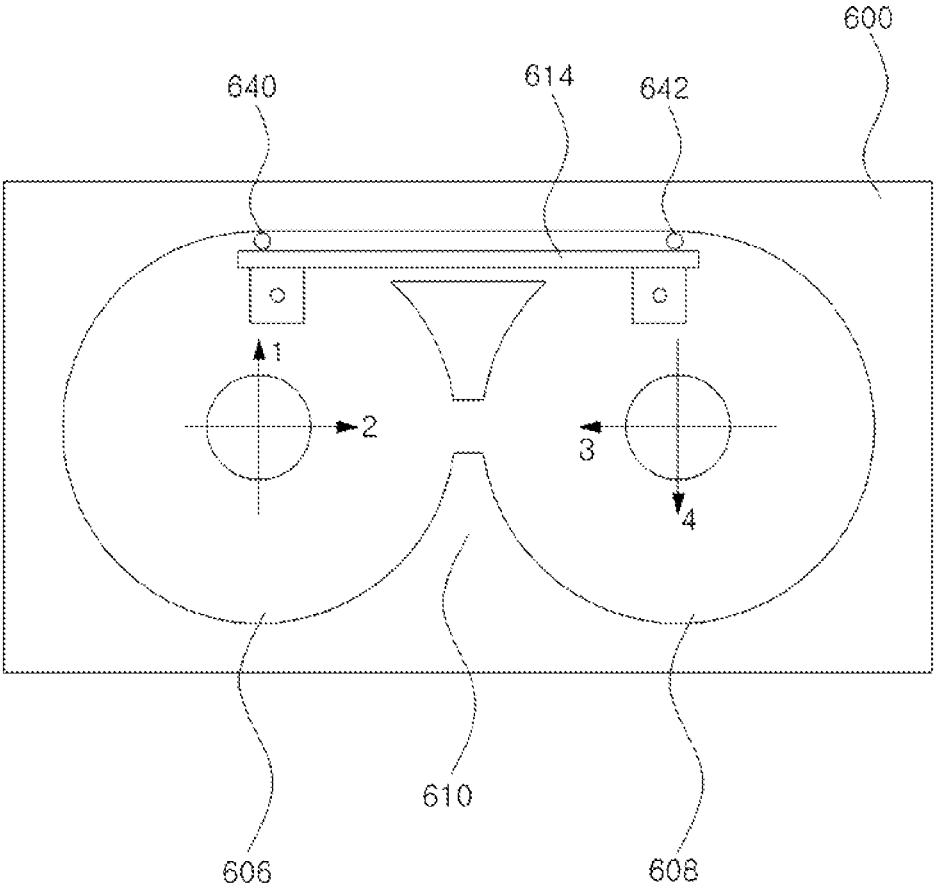
FIG. 7 is a plan view illustrating the multi-mode filter according to the second embodiment of the present invention.
Figure 8:
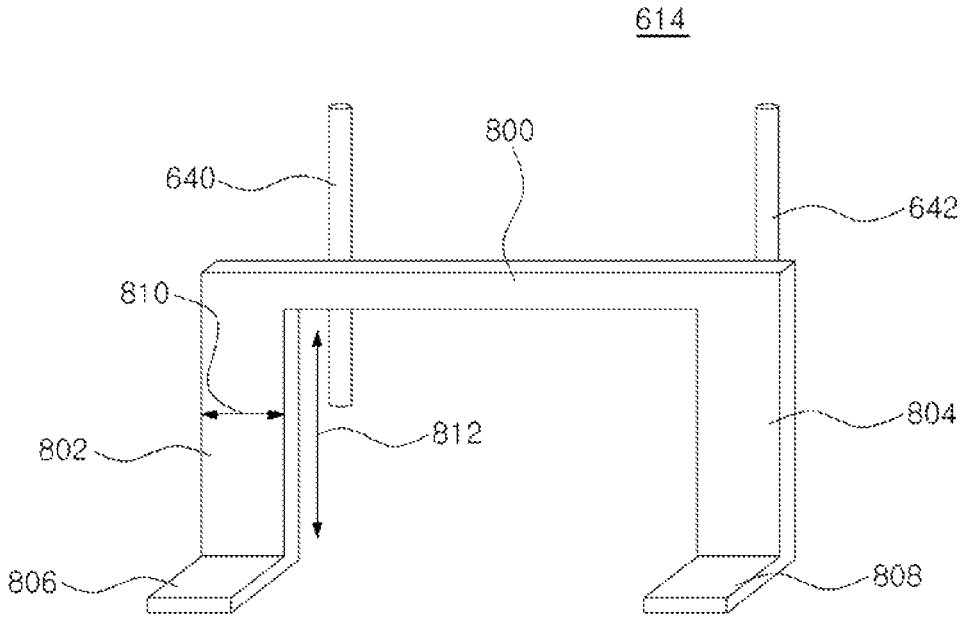
FIG. 8 is a perspective view illustrating a coupling element and a tuning element according to one embodiment of present invention.

FIGS. 6A and 6B are perspective views illustrating a multi-mode filter according to a second embodiment of the present invention, FIG. 7 is a plan view illustrating the multi-mode filter according to the second embodiment of the present invention, and FIG. 8 is a perspective view illustrating a coupling element and a tuning element according to one embodiment of present invention. In FIG. 6(B), some elements of the multi-mode filter are not shown for illustrating exact disposition of a first tuning element 640 and a second tuning element 642.

Referring to FIGS. 6A and 6B, the multi-mode filter according to the present embodiment is a filter tunable coupling value, and includes a housing 600, a cover 601, a first cavity 602, a second cavity 604, a first resonator 606, a second resonator 608, a wall 610, a first coupling dement 614, a second coupling element 622, a fixing member 624, a first tuning element 640 and a second tuning element 642.

The multi-mode filter according to the present embodiment and the multi-mode filter according to the first embodiment of the present invention is the same except for the cover 601, the first tuning element 640 and the second tuning element 642. Therefore, any further description concerning the same elements will be omitted.

The cover 601 is combined with an upper surface of the housing 600, for example may be combined with the upper surface of the housing 600 through a bolt, etc. The cover 601 may be formed by for example coating silver on aluminum material, and functions as a ground.

The first tuning element 640 is made up of for example a metal and inserted in the first cavity 602 under the condition that it combines with the cover 601. However, the first tuning element 640 does not contact with a bottom surface of the housing 600.

According to one embodiment of the present invention, the first tuning element 640 is disposed between the first coupling element 614 and an inner surface of the housing 600 corresponding to the first cavity 602. Specially, the first tuning element 640 may be disposed to the second coupling member 802. Meanwhile, the first tuning element 640 may be disposed between the first coupling element 614 and the first resonator 606, but in terms of coupling efficiency, it is preferable that the first tuning element 640 is disposed between the first coupling element 614 and the inner surface of the housing 600.

In case that the first tuning element 640 is disposed between the first coupling element 614 and the inner surface of the hosing 600, capacitive coupling amount is decreased, inductive coupling amount is retained, thus overall coupling amount is increased.

Meanwhile, in case that the first coupling element 614 is fixed on the bottom surface of the housing 600, mechanical tolerance may occur. Desired coupling value may not be realized due to the mechanical tolerance, but the multi-mode filter compensates coupling value error due to the mechanical tolerance using the first tuning element 640, thereby realizing desired coupling value. In other words, the multi-mode filter may achieve desired coupling value by using the first tuning element 640 regardless of the mechanical tolerance.

According to one embodiment of the present invention, to tune electrical coupling value, the first tuning element 640 may move up and down with combined with the cover 601 shown in FIG. 6(B). In the actual tuning process, the first tuning element 640 moves up and down to adjust coupling value, and in case that coupling value is adjusted to the desired value, the first coupling element 640 is fixed at corresponding position.

The second tuning element 642 is made up of for example a metal and inserted in the second cavity 604 under the condition that it combines with the cover 601. However, the second tuning element 642 does not contact with the bottom surface of the housing 600.

According to one embodiment of the present invention, the second tuning element 642 is disposed between the first coupling element 614 and the inner surface of the housing 600 corresponding to the second cavity 604. Specially, the second tuning element 642 may be disposed to the third coupling member 804. Meanwhile, the second tuning element 642 may be disposed between the first coupling element 614 and the first resonator 606.

The first tuning element 640 and the second tuning element have same size and are disposed symmetrically around the wall 610. In addition, the second tuning element 642 may move up and down with combined with the cover 601 to tune coupling value shown in FIG. 6(B).

According to another embodiment of the present invention, the first tuning element 640 and the second tuning element 642 have different size. For example, the first tuning element 640 and the second tuning element 642 have cylindrical shape, and a radius of the first tuning element 640 is larger than a radius of the second tuning element 642.

In brief, the multi-mode filter of the second embodiment of the present invention may control electrical coupling between the first resonator 606 and the second resonator 608 using first coupling element 614, and tune electrical coupling value to desired value using the first tuning element 640 and the second tuning element 642.

In above, one tuning element 640 or 642 is located each of the cavities 602 and 604, but tuning element 640 or 642 may be located in only one cavity 602 or 604, or plural tuning element are located each of the cavities 602 and 604.

Comparison between conventional dual-mode filter and the multi-mode filter according to the second embodiment of the present invention is as follows.

The conventional dual-mode filter controls only E-field coupling (capacitive coupling) through coupling window, therefore it is impossible to obtain desired coupling value at dual-mode filter.

On the other hand, the multi-mode filter according to the present embodiment controls electrical coupling value between the resonators 606 and 608 using both E-field coupling (capacitive coupling) and H-field coupling (inductive coupling). Consequently, the multi-mode filter may obtain sufficient coupling value. Specially, since the first coupling element 614 may be modified with various structures the coupling value may be tuned by using the tuning elements 640 and 632, the multi-mode filter according to the second embodiment of the present invention may achieve various coupling values.

In addition, because the first coupling element 114 is fixed on the bottom surface of the housing 100 through the metal screw, the first coupling element 114 may be fixed stably even if an external impact (vibration, extreme changes in temperature, shock etc.) occurs. Meanwhile, according to the second embodiment of, the present invention, mechanical tolerance may be generated but difference between coupling values due to the mechanical tolerance may be compensated using the tuning elements 640 and 642.

Hereinafter, experimental result about the multi-mode filter according to the second embodiment of the present invention will be described in detail with reference to accompanying drawings.

Figure 9:
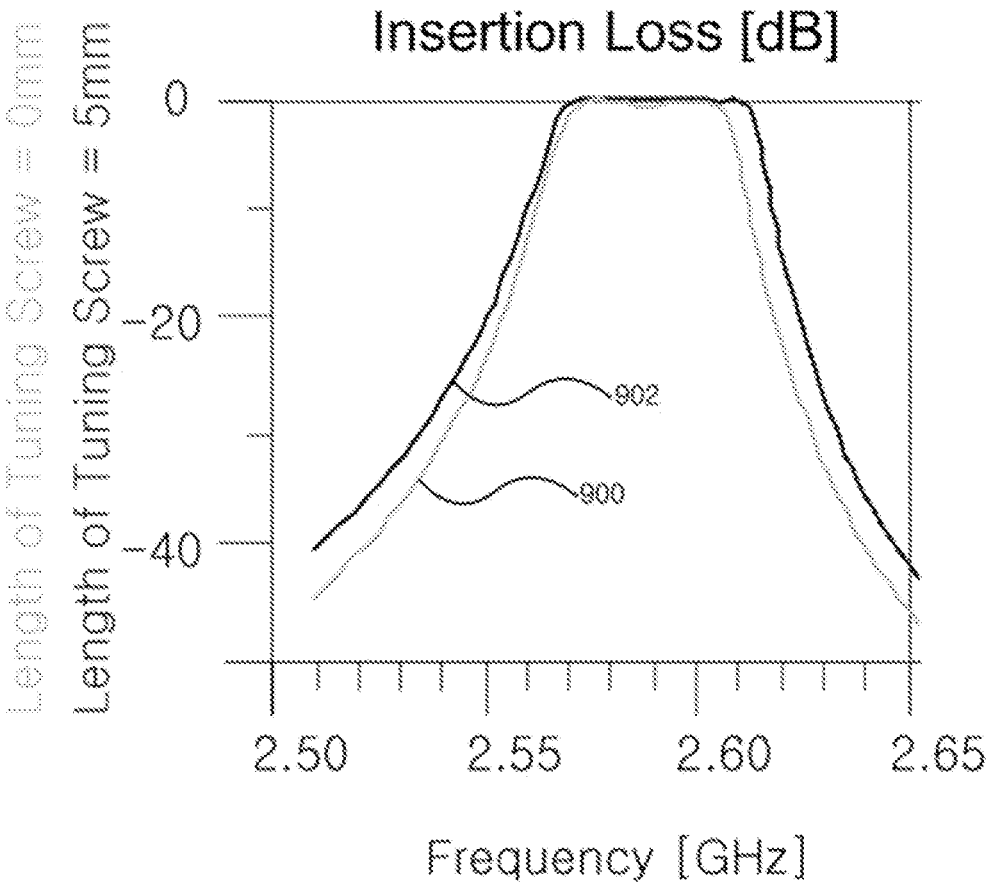
FIG. 9 is a view illustrating insertion loss in accordance with location of the tuning element at the multi-mode filter according to the second embodiment of the present invention.

FIG. 9 is a view illustrating insertion loss in accordance with location of the tuning element at the multi-mode filter according to the second embodiment of the present invention. Particularly, FIG. 9 illustrates a waveform 900 of insertion loss when the tuning element 640 and 642 enter into corresponding cavities by 0 mm and a waveform 902 of insertion loss when the tuning elements 640 and 642 enter into the cavities by 5 mm.

Referring to FIG. 9, it is verified that at a band where loss insertion is approximately zero, bandwidth of the waveform 902 is wider than that of the waveform 900. That is, it is verified that bandwidth may be tuned by adjusting entering depth of the tuning elements 640 and 642.

Figure 10:
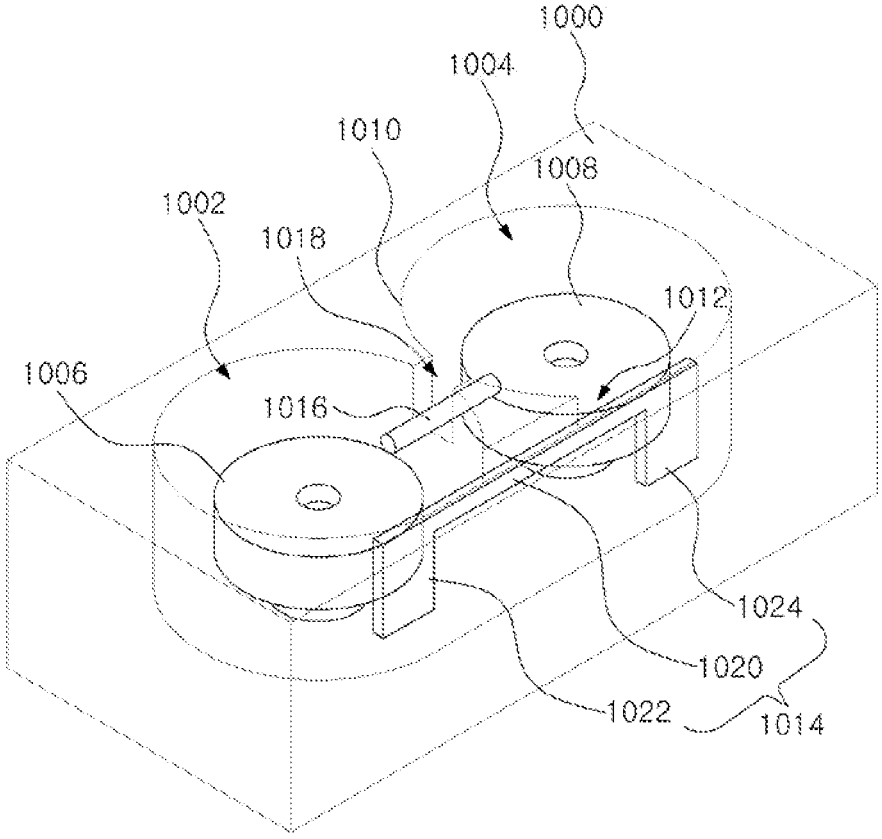
FIG. 10 is a perspective view illustrating a multi-mode filter according to a third embodiment of the present invention.
Figure 11:
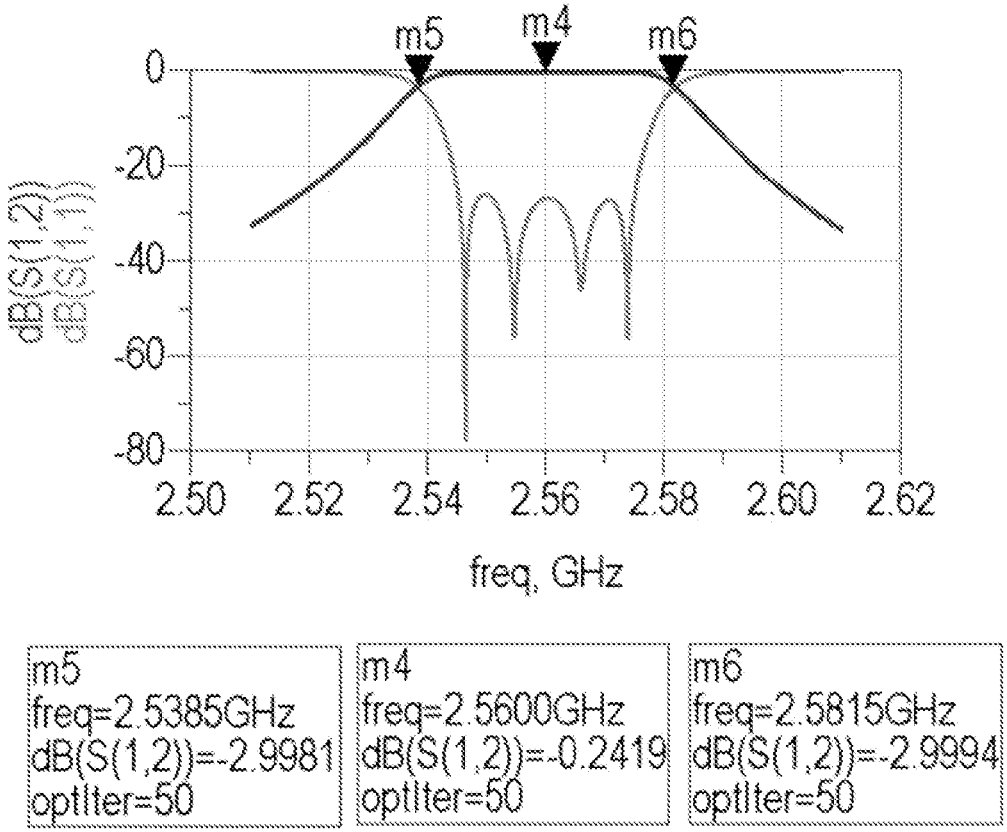
FIG. 11 is a view illustrating result graph of coupling simulation about the multi-mode filter according to the third embodiment of the present invention.

FIG. 10 is a perspective view illustrating a multi-mode filter according to a third embodiment of the present invention, FIG. 11 is a view illustrating result graph of coupling simulation about the multi-mode filter according to the third embodiment of the present invention.

Referring to FIG. 10, the multi-mode filter according to the present embodiment includes a housing 1000, a first cavity 1002, a second cavity 1004, a first resonator 1006, a second resonator 1008, a wall 1010, a first coupling element 1014 and a second coupling element 1016.

The multi-mode filter according to the present embodiment and the multi-mode filter according to the first embodiment of the present invention is the same except for the first coupling element 1014. Therefore, any further description concerning the same elements will be omitted.

The first coupling element 1014 has "⊓" shape and includes a first coupling member 1020, a second coupling member 1022 and a third coupling member 1024.

The first coupling element 1020 is inserted in a home 1012 between the housing 1000 and the wall 1010. Here, although not shown in FIG. 10, the first coupling member 1020 may be fixed by fixing member and separated physically from the housing 1000 like the multi-mode filter according to the first embodiment of the present invention.

The second coupling member 1022 is longitudinal-extended from the first coupling member 1020 300 in the direction vertical to the first coupling member 1020, and it is located in the first cavity 1002. Here, the second coupling member 1022 is separated physically from a bottom surface and a side surface of the housing 1000.

The third coupling member 1024 is longitudinal-extended from the first coupling member 1020 in the direction vertical to the first coupling member 1020, and it is located in the second cavity 1004. Here, the third coupling member 1024 is separated physically from the bottom surface and the side surface of the housing 1000.

In other words, the first coupling element 1014 is located in the cavities 1002 and 1004 under the condition that it is electrically open. In this case, like the multi-mode filter according to the first embodiment of the present invention, both E-field coupling and H-field coupling are generated and sufficient coupling amount may be obtained between resonators 1006 and 1008.

In addition, a structure of the coupling element 1014 may be modified variously, therefore, the multi-mode filter according to the third embodiment of the present invention may achieve various coupling values.

Furthermore, referring to FIG. 11, the multi-mode filter according to the present embodiment may realize bandwidth of 42 MHz at center frequency of 2.56 GHz, i.e. realizes wide band of 1.64% with.

Figure 12:
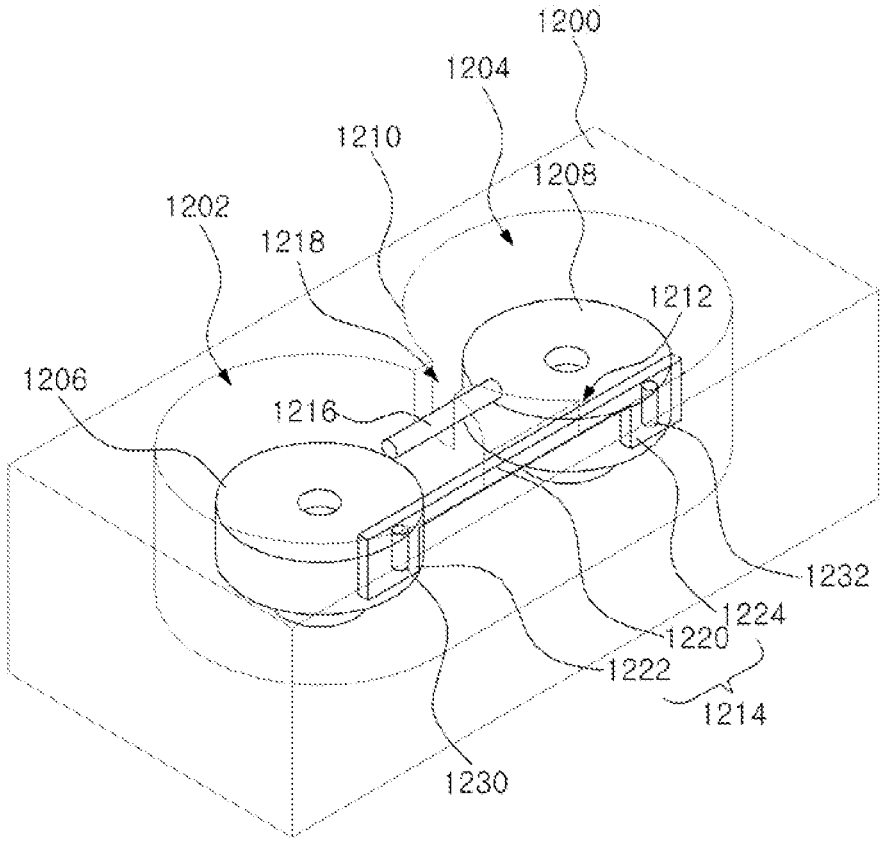
FIG. 12 is a perspective view illustrating a multi-mode filter according to a fourth embodiment of the present invention.

FIG. 12 is a perspective view illustrating a multi-mode filter according to a fourth embodiment of the present invention.

Referring to FIG. 12, the multi-mode filter according to the present embodiment includes a housing 1200, a first cavity 1202, a second cavity 1204, a first resonator 1206, a second resonator 1208, a wall 1210, a first coupling element 1214, a second coupling element 1216, a first tuning element 1230 and a second tuning element 1232.

The multi-mode filter according to the present embodiment and the multi-mode filter according to the third embodiment of the present invention is the same except for the first tuning element 1230 and a second tuning element 1232. Therefore, any further description concerning the same elements will be omitted.

The first tuning element 1230 may be disposed at the rear of the second coupling element 1222 under the condition that it is located in the first cavity 1202, and the second tuning element 1232 may be disposed at the rear of the third coupling element 1224 under the condition that it is located in the second cavity 1204

In brief, the multi-mode filter according to the present invention may obtain sufficient coupling value for the multi-mode filter by using the coupling element having "⊓" shape and being located in the cavities with inserted in the groove between the housing and the wall. In addition, the multi-mode filter may achieve various coupling values by adjusting the area and height of the coupling element. Here, the coupling element may be electrically short or open.

Furthermore, regardless the coupling element is short or open, coupling value may be tuned by disposing the at least one tuning element between coupling element and the inner surface of the housing.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A multi-mode filter comprising:

a housing;

a first cavity and a second cavity formed in the housing;

a first resonator located in the first cavity;

a second resonator located in the second cavity;

a wall configured to separate the first cavity from the second cavity; and a first coupling element, wherein a groove is formed between the housing and the wall, the first coupling element is located in the groove in the direction crossing over the wall, a part of the first coupling element is disposed in the first cavity, another part of the first coupling element is disposed in the second cavity, the first coupling element is electrically connected to a ground, and the first coupling element performs electrical coupling between the first resonator and the second resonator using both E-field coupling and H-field coupling.

2. The multi-mode filter of claim 1, wherein the first coupling element has "⊓" shape.

3. The multi-mode filter of claim 2, wherein the first coupling element "⊓" shape is defined by, a first coupling member inserted in the groove;

a second coupling member longitudinal-extended from the first coupling member in the direction vertical to the first coupling member, the second coupling member being disposed in the first cavity;

a third coupling member longitudinal-extended from the first coupling member in the direction vertical to the first coupling member, the third coupling member locating in the second cavity;

a fourth coupling member longitudinal-extended from the second coupling member in the direction vertical to the second coupling member, the fourth coupling member being connected electrically to a bottom surface of the housing corresponding to the first cavity; and a fifth coupling member longitudinal-extended from the third coupling member in the direction vertical to the third coupling member, the fifth coupling member being connected electrically to the bottom surface of the housing corresponding to the second cavity, wherein the fourth coupling member and the fifth coupling member are connected to the bottom surface of the housing through a metal screw.

4. The multi-mode filter of claim 1, wherein a coupling window is formed in the middle of the wall, a second coupling element is inserted in the coupling window, one end part of the second coupling element is disposed in the first cavity, the other end part of the second coupling element is disposed in the second cavity.

5. The multi-mode filter of claim 1, further comprising:

at least one tuning element which is located in at least one of the first cavity and the second cavity, and disposed to face the first coupling element.

6. The multi-mode filter of claim 5, further comprising:

a cover for covering the housing, wherein a first tuning element of the at least one tuning element is disposed in the first cavity and combined with the cover, a second tuning element of the at least one tuning element is located in the second cavity and combined with the cover, the first tuning element is disposed between the first coupling element and an inner surface of the housing corresponding to the first cavity, the second tuning element is located between the first coupling element and an inner surface of the housing corresponding to the second cavity, and the first tuning element and the second tuning element move up and down when combined with the cover.

7. The multi-mode filter of claim 6, wherein the first coupling element comprises, a first coupling member inserted in the groove;

a second coupling member longitudinal-extended from the first coupling member in the direction vertical to the first coupling member, the second coupling member being disposed in the first cavity;

a third coupling member longitudinal-extended from the first coupling member in the direction vertical to the first coupling member, the third coupling member being disposed in the second cavity;

a fourth coupling member longitudinal-extended from the second coupling member in the direction vertical to the second coupling member, the fourth coupling member being connected electrically to a bottom surface of the housing corresponding to the first cavity; and a fifth coupling member longitudinal-extended from the third coupling member in the direction vertical to the third coupling member, the fifth coupling member being connected electrically to the bottom surface of the housing corresponding to the second cavity, wherein the fourth coupling member and the fifth coupling member are connected to the bottom surface of the housing through a metal screw, the first tuning element is disposed between the second coupling member and an inner surface of the housing corresponding to the first cavity, the second tuning element is disposed between the third coupling member and an inner surface of the housing corresponding to the second cavity.

8. A multi-mode filter comprising:

a housing;

a first cavity and a second cavity formed in the housing;

a first resonator located in the first cavity;

a second resonator located in the second cavity;

a wall configured to separate the first cavity from the second cavity; and a coupling element, wherein a groove is formed between the housing and the wall, the coupling element is located in the groove in the direction crossing over the wall, a part of the coupling element is disposed in the first cavity, another part of the coupling element is disposed in the second cavity, and the coupling element is electrically open, and the coupling element couples the first resonator with the second resonator using both E-field coupling and H-field coupling.

9. The multi-mode filter of claim 8, wherein the coupling element has "⊓" shape.

10. The multi-mode filter of claim 8, wherein the first coupling element "⊓" shape is defined by, a first coupling member inserted in the groove;

a second coupling member longitudinal-extended from the first coupling member in the direction vertical to the first coupling member, the second coupling member being disposed in the first cavity;

a third coupling member longitudinal-extended from the first coupling member in the direction vertical to the first coupling member, the third coupling member being disposed in the second cavity;

wherein the second coupling member is disposed between an inner surface of the housing corresponding to the first cavity and the first resonator with separated physically from the inner surface of the housing, the third coupling member is disposed between the inner surface of the housing corresponding to the second cavity and the second resonator with separated physically from the inner surface of the housing corresponding to the second cavity, and the second coupling member and the third coupling member is separated physically from bottom surfaces of the housing corresponding to the first cavity and the second cavity.

11. The multi-mode filter of claim 10, further comprising:

a fixing member for fixing the first coupling member to be supported by the housing and the wall.

12. The multi-mode filter of claim 8, further comprising:

at least one tuning element which is located in at least one of the first cavity and the second cavity, and disposed to face the first coupling element.

13. The multi-mode filter of claim 12, further comprising:

a cover for covering the housing, wherein a first tuning element of the at least one tuning element is disposed in the first cavity and combined with the cover, a second tuning element of the at least on tuning element is disposed in the second cavity and combined with the cover, the first tuning element is disposed between the first coupling element and an inner surface of the housing corresponding to the first cavity, the second tuning element is disposed between the first coupling element and an inner surface of the housing corresponding to the second cavity, and the first tuning element and the second tuning element move up and down when combined with the cover.

14. The multi-mode filter of claim 13, wherein the first element comprise, a first coupling member inserted in the groove;

a second coupling member longitudinal-extended from the first coupling member in the direction vertical to the first coupling member, the second coupling member being disposed in the first cavity;

a third coupling member longitudinal-extended from the first coupling member in the direction vertical to the first coupling member, the third coupling member being disposed in the second cavity;

wherein the second coupling member is disposed between an inner surface of the housing corresponding to the first cavity and the first resonator with separated physically from the inner surface of the housing corresponding to the first cavity, the third coupling member is disposed between the inner surface of the housing corresponding to the second cavity and the second resonator with separated physically from the inner surface of the housing corresponding to the second cavity, the second coupling member and the third coupling member is separated physically from bottom surfaces of the housing corresponding to the first cavity and the second cavity, the first tuning element is disposed between the second coupling member and the inner surface of the housing corresponding to the first cavity, the second tuning element is disposed between the third coupling member and the inner surface of the housing corresponding to the second cavity.

15. A multi-mode filter comprising:

a housing;

a first cavity and a second cavity formed in the housing;

a first resonator located in the first cavity;

a second resonator located in the second cavity;

a wall configured to separate the first cavity from the second cavity;

a first coupling element; and at least one tuning element, a cover to cover the housing;

wherein a groove is formed between the housing and the wall, the first coupling element is inserted in the groove in the direction crossing over the wall, a part of the first coupling element is disposed in the first cavity, another part of the first coupling element is disposed in the second cavity, the at least one tuning element is disposed to face the first coupling element which is located in at least one of the first cavity and the second cavity, the at least one tuning element is combined with the cover and the at least one tuning element moves up and down.

* * * * *